US010352565B2

(12) United States Patent
Harada

(10) Patent No.: US 10,352,565 B2
(45) Date of Patent: Jul. 16, 2019

(54) GLOW PLUG

(71) Applicant: NGK SPARK PLUG CO., LTD., Nagoya-shi, Aichi (JP)

(72) Inventor: Hiroshi Harada, Tajimi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 564 days.

(21) Appl. No.: 14/418,316

(22) PCT Filed: Aug. 7, 2013

(86) PCT No.: PCT/JP2013/004768
§ 371 (c)(1),
(2) Date: Jan. 29, 2015

(87) PCT Pub. No.: WO2014/024485
PCT Pub. Date: Feb. 13, 2014

(65) Prior Publication Data

US 2015/0292739 A1 Oct. 15, 2015

(30) Foreign Application Priority Data

Aug. 8, 2012 (JP) ..... 2012-175845

(51) Int. Cl.
*F23Q 7/00* (2006.01)
*H05B 3/06* (2006.01)
(Continued)

(52) U.S. Cl.
CPC ..... *F23Q 7/001* (2013.01); *H05B 3/03* (2013.01); *H05B 3/06* (2013.01); *H05B 3/48* (2013.01); *H05B 2203/027* (2013.01)

(58) Field of Classification Search
CPC ..... F23Q 7/001; H05B 2203/027; H05B 3/03; H05B 3/06; H05B 3/48
See application file for complete search history.

(56) References Cited

U.S. PATENT DOCUMENTS

RE31,908 E * 6/1985 Petrik ..... F23Q 7/001 123/145 A
6,064,039 A * 5/2000 Kumada ..... F23Q 7/001 123/145 A
(Continued)

FOREIGN PATENT DOCUMENTS

JP 09-42671 A 2/1997
JP 2005-147533 A 6/2005
(Continued)

OTHER PUBLICATIONS

Translation JP2010139152.*
(Continued)

*Primary Examiner* — Ibrahime A Abraham
*Assistant Examiner* — Frederick F Calvetti
(74) *Attorney, Agent, or Firm* — Sughrue Mion, PLLC

(57) ABSTRACT

A glow plug having a rod-shaped heater including a resistance heating element; a tubular metallic shell; a rod-shaped inner shaft accommodated in the metallic shell and to which electric current is applied externally; and a conductive tubular member disposed inside the metallic shell. The tubular member has openings at its opposite ends. The rear end of the heater is press-fitted into one of the openings, and the front end portion of the inner shaft is inserted into the other opening, whereby the resistance heating element and the inner shaft are electrically connected. The heater includes an electrode terminal portion formed on the outer circumferential surface thereof. The tubular member includes an intermediate portion located between the one end and the other end and in contact with the electrode terminal portion, and the wall thickness at the one end is smaller than the wall thickness at the intermediate portion.

8 Claims, 11 Drawing Sheets

(51) Int. Cl.
*H05B 3/48* (2006.01)
*H05B 3/03* (2006.01)

(56) References Cited

U.S. PATENT DOCUMENTS 6,881,930 B2 * 4/2005 Yoshikawa ..... F23Q 7/001 123/145 A
7,223,942 B2 * 5/2007 Konishi ..... F23Q 7/00 123/179.6
7,420,139 B2 * 9/2008 Yoshikawa ..... F23Q 7/001 219/270
7,692,118 B2 * 4/2010 Itoh ..... F23Q 7/001 219/260
2005/0104496 A1 5/2005 Ando
2009/0184101 A1 * 7/2009 Hoffman ..... F23Q 7/001 219/270
2011/0114622 A1 * 5/2011 Sekiguchi ..... F23Q 7/001 219/270
2012/0187101 A1 * 7/2012 Hatano ..... F23Q 7/001 219/260
2014/0196680 A1 * 7/2014 Torazawa ..... H05B 3/48 123/145 A

FOREIGN PATENT DOCUMENTS

JP 2006-153338 A 6/2006
JP 2010-139152 A 6/2010
JP 2010139152 * 6/2010
JP 2010-181068 A 8/2010
JP 2011-017478 A 1/2011

OTHER PUBLICATIONS

International Search Report of PCT/JP2013/004768 dated Sep. 3, 2013 [PCT/ISA/210].
Communication dated Mar. 16, 2016, issued by the Korean Intellectual Property Office in corresponding Korean Application No. 10-2015-7005677.

* cited by examiner

| SAMPLE No. | DISTANCE D1 FROM END FACE TO ELECTRODE [mm] | EVALUATION OF RESISTANCE |
|---|---|---|
| S1 | 1.22 | ACCEPTABLE |
| S2 | 1.05 | ACCEPTABLE |
| S3 | 0.82 | ACCEPTABLE |
| S4 | 0.75 | ACCEPTABLE |
| S5 | 0.68 | ACCEPTABLE |
| S6 | 0.60 | ACCEPTABLE |
| S7 | 0.40 | UNACCEPTABLE |

| SAMPLE No. | SEPARATION DISTANCE C BETWEEN METALLIC SHELL AND TUBULAR MEMBER [mm] | RESULTS OF SHORT CIRCUIT TEST |
|---|---|---|
| S11 | 0.6 | ACCEPTABLE |
| S12 | 0.5 | ACCEPTABLE |
| S13 | 0.4 | ACCEPTABLE |
| S14 | 0.3 | ACCEPTABLE |
| S15 | 0.2 | ACCEPTABLE |
| S16 | 0.1 | UNACCEPTABLE |

GLOW PLUG

CROSS REFERENCE TO RELATED APPLICATIONS

This application is a National Stage of International Application No. PCT/JP2013/004768, filed Aug. 7, 2013, claiming priority based on Japanese Patent Application No. 2012-175845, filed Aug. 8, 2012, the contents of all of which are incorporated herein by reference in their entirety.

TECHNICAL FIELD

The present invention relates to a glow plug.

BACKGROUND ART

A glow plug is used as an auxiliary heat source for a compression ignition internal combustion engine (such as a diesel engine). In one known technique for the glow plug, a rod-shaped inner shaft and a rod-shaped ceramic heater disposed at the front end of the inner shaft are connected through a conductive ring member (for example, Japanese Patent Application Laid-Open (kokai) No. 2006-153338).

SUMMARY OF THE INVENTION

Problems to be Solved by the Invention

However, when the inner shaft and the ceramic heater are connected through the ring member, the heater must be press-fitted into the axial bore of the ring member. Therefore, residual stress produced as a result of press-fitting remains in the heater with the ring member attached thereto. When such residual stress remains, the heater may break easily, for example, upon reception of impact. In addition, there is a risk that when the heater is press-fitted into the axial bore of the ring member, the heater easily breaks. When the diameter of the axial bore of the ring member is made excessively large as compared with the diameter of the heater in order to facilitate press-fitting, the contact pressure between the heater and the ring member attached thereto decreases, so the contact resistance therebetween may increase.

Means for Solving the Problems

To solve, at least partially, the above problems, the present invention can be embodied in the following modes.

(1) One mode of the present invention is a glow plug comprising a rod-shaped heater extending along an axis and including a resistance heating element held inside the heater; a tubular metallic shell which accommodates the heater with a front end portion of the heater protruding from the metallic shell; a rod-shaped inner shaft which is accommodated in the metallic shell and to which electric current is applied externally; and a conductive tubular member disposed inside the metallic shell, the tubular member having a first end with an opening into which a rear end portion of the heater is press-fitted and a second end with an opening into which a front end portion of the inner shaft is inserted, whereby the resistance heating element of the heater and the inner shaft are electrically connected to each other. The glow plug is characterized in that the heater includes an electrode terminal portion formed on an outer circumferential surface thereof and electrically connected to the resistance heating element, the tubular member includes an intermediate portion located between the first end and the second end and in contact with the electrode terminal portion, and a wall thickness of the tubular member at the first end is smaller than a wall thickness of the tubular member at the intermediate portion. In the glow plug of this mode, the contact pressure acting on the heater from the first end of the tubular member is lower than the contact pressure acting on the heater from the intermediate portion of the tubular member. Therefore, breakage of the heater when or after the heater is press-fitted into the tubular member is prevented. Since the contact pressure acting on the electrode terminal portion of the heater from the intermediate portion of the tubular member is secured, an increase in the contact resistance between the tubular member and the heater is suppressed.

(2) In the glow plug of the above-described mode, a wall thickness of the tubular member at the second end may be smaller than the wall thickness of the tubular member at the intermediate portion. In the glow plug of this mode, breakage of the heater is prevented regardless of whether the heater is press-fitted into the first or second end of the tubular member. Therefore, it is not necessary to check the orientation of the tubular member when the heater is press-fitted into the tubular member. This saves time and effort required to orient the tubular member during a production process for the glow plug, so that production cost can be reduced. In addition, the inner shaft can be easily attached to the tubular member.

(3) In the glow plug of the above-described mode, the tubular member may increase in wall thickness continuously from the first end toward the intermediate portion. In the glow plug of this mode, the contact pressure acting on the rear end portion of the heater from the tubular member increases continuously from the first end of the tubular member toward its intermediate portion. Therefore, the breakage of the heater is further prevented.

(4) In the glow plug of the above-described mode, a distance between the electrode terminal portion of the heater and an end face of the tubular member located at the first end and having the opening may be 0.6 mm or more. In the glow plug of this mode, an increase in the contact resistance between the tubular member and the electrode terminal portion is suppressed.

(5) In the glow plug of the above-described mode, the tubular member may have a thick walled portion including the intermediate portion and having a wall thickness equal to or greater than the average of the minimum and maximum values of the wall thickness of the tubular member, and the thick walled portion may be disposed so as to entirely cover at least a region extending 0.6 mm from an outer circumference of the electrode terminal portion of the heater. In the glow plug of this mode, the increase in the contact resistance between the tubular member and the electrode terminal portion is further suppressed.

(6) In the glow plug of the above-described mode, a distance between an outer circumferential surface of the tubular member and an inner circumferential surface of the metallic shell may be at least 0.2 mm. In the glow plug of this mode, the occurrence of a short circuit between the tubular member and the metallic shell is suppressed.

(7) In the glow plug of the above-described mode, the tubular member may be configured such that an area of a cross section thereof that is perpendicular to a virtual center axis of the tubular member and is taken at a minimum wall-thickness portion having a minimum wall thickness is determined on the basis of a 0.2% proof stress of a material forming the tubular member. In the glow plug of this mode, the strength of the minimum wall-thickness portion can be secured such that deformation of the tubular member when the heater is press-fitted is suppressed.

(8) In the glow plug of the above-described mode, the tubular member may be formed of a material having a 0.2% proof stress of 130 kgf/mm$^2$ or less, and the area of the cross section at the minimum wall-thickness portion may be 1.5 mm$^2$ or more. In the glow plug of this mode, the deformation of the tubular member when the heater is press-fitted is more reliably suppressed.

(9) In the glow plug of the above-described mode, the tubular member may be in contact with the electrode terminal portion at a position at which the tubular member has the maximum wall thickness. In the glow plug of this mode, the contact resistance between the tubular member and the electrode terminal portion is reduced.

The present invention can be implemented in various forms. For example, the present invention can be implemented in forms such as a tubular member for connecting an inner shaft and a heater, an internal combustion engine including a glow plug, and a method of producing a glow plug. The present invention is not limited to the above-described forms, and it will be appreciated that the present invention can be implemented in various forms without departing from the spirit of the invention.

MODES FOR CARRYING OUT THE INVENTION

A. First Embodiment

Figure 1:
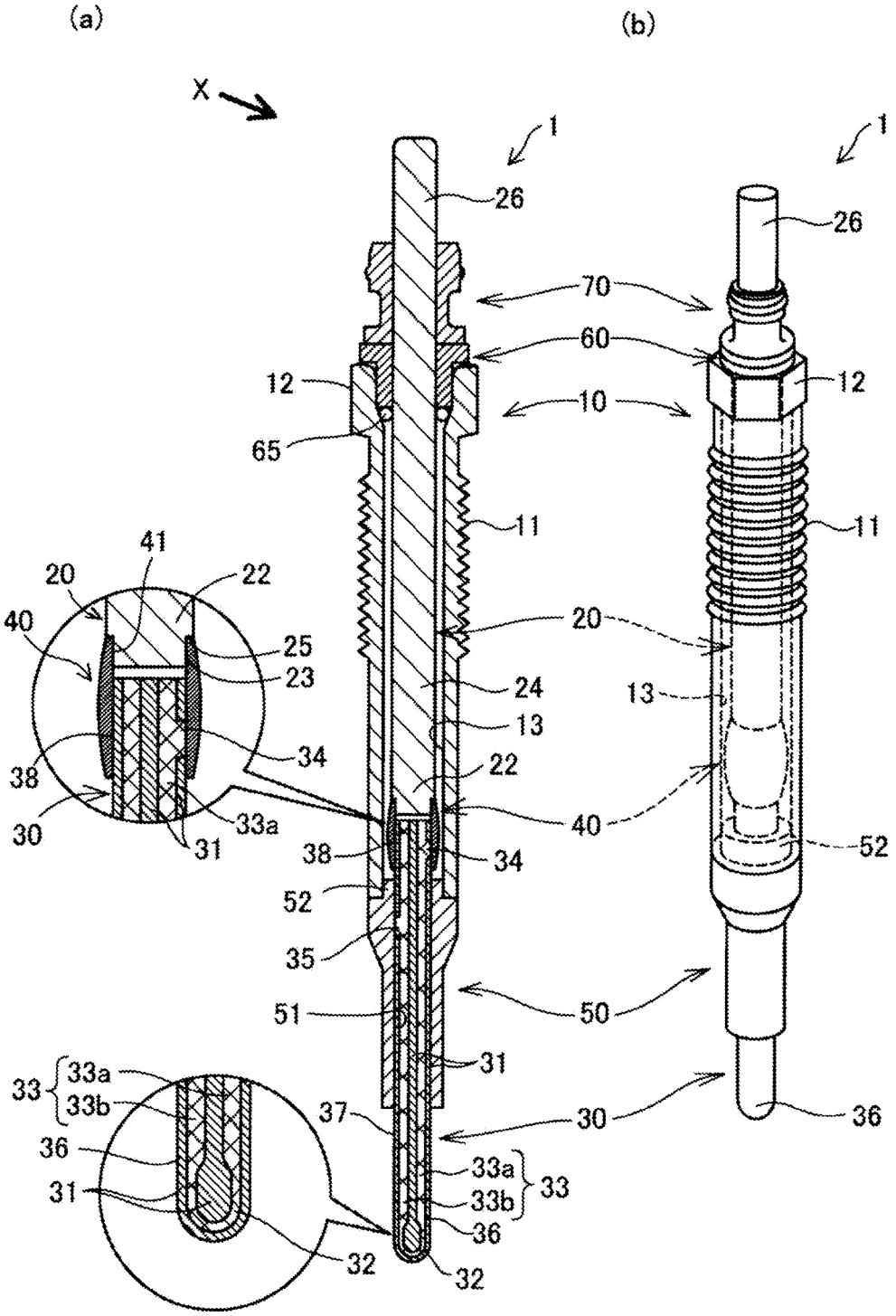
FIGS. 1(*a*) and 1(*b*) are a set of views schematically showing the structure of a glow plug of a first embodiment.

FIG. 1 is a set of views schematically showing the structure of a glow plug of a first embodiment of the present invention. FIG. 1(*a*) shows the cross-sectional configuration of the glow plug 1. FIG. 1(*b*) shows the external view of the glow plug 1 as viewed in an oblique direction (in a direction along arrow X in FIG. 1(*a*)). In FIG. 1(*b*), part of components inside the glow plug 1 are represented by broken lines. In the following description, the side of the glow plug 1 on which a ceramic heater 30 is disposed (the lower side in FIG. 1) is referred to as the "front side" of the glow plug 1, and the side on which an annular member 70 is disposed (the upper side in FIG. 1) is referred to as the "rear side" of the glow plug 1.

The glow plug 1 includes a metallic shell 10, an inner shaft 20, the ceramic heater 30, a tubular member 40, a sleeve 50, an insulating member 60, and the annular member 70. The metallic shell 10 has a substantially tubular outer shape and accommodates the inner shaft 20. The inner shaft 20 has a substantially rod-like outer shape, and its rear end portion 26 protrudes from the metallic shell 10. A front end portion 22 of the inner shaft 20 is disposed so as to face a rear end portion 38 of the ceramic heater 30. The ceramic heater 30 has a substantially rod-like outer shape and is held by the sleeve 50 with a front end portion 36 of the ceramic heater 30 protruding from the sleeve 50. The tubular member 40 is disposed inside an axial bore 13 of the metallic shell 10 and connects the front end portion 22 of the inner shaft 20 to the rear end portion 38 of the ceramic heater 30. The sleeve 50 has a substantially tubular outer shape and is joined to the front end of the metallic shell 10. The insulating member 60 and an O-ring 65 are disposed between the rear opening of the metallic shell 10 and the inner shaft 20. The annular member 70 is disposed rearward of the insulating member 60. The glow plug 1 is configured such that the virtual center axes of the metallic shell 10, the inner shaft 20, the ceramic heater 30, the tubular member 40, and the sleeve 50 coincide with the virtual center axis of the glow plug 1.

The metallic shell 10 is formed of, for example, carbon steel or stainless steel and includes a mounting screw portion 11, a tool engagement portion 12, and the axial bore 13. The mounting screw portion 11 is a portion having a screw thread and is screwed into a screw hole of a diesel engine head (not shown). The tool engagement portion 12 is a portion for engagement with an attachment tool and is formed rearward of the mounting screw portion 11. The axial bore 13 is a hollow space extending in the axial direction of the metallic shell 10, and the inner shaft 20, the tubular member 40, and the rear end portion 38 of the ceramic heater 30 are disposed in the axial bore 13.

The inner shaft 20 is formed of an electrically conductive material such as carbon steel or stainless steel and includes, at the front end portion 22, a small-diameter portion 23 and a step portion 25. The small-diameter portion 23 is formed such that its outer diameter is smaller than the outer diameter of a main shaft portion 24 which is a portion of the inner shaft 20 and is located rearward of the small-diameter portion 23. The step portion 25 is a step formed at the boundary between the small-diameter portion 23 and the main shaft portion 24 and has an annular surface facing frontward. The inner shaft 20 is electrically connected at its front end portion 22 to the ceramic heater 30 through the conductive tubular member 40 (the details will be described later). The rear end portion 26 of the inner shaft 20 protrudes from the metallic shell 10 and forms, in cooperation with the conductive annular member 70, a terminal portion of the glow plug 1. This terminal is connected to an external power source (not shown). The power of the external power source is thereby led to the ceramic heater 30 through the inner shaft 20.

The ceramic heater 30 includes a substantially rod-shaped insulating ceramic base 31. A heating element 32 and first and second lead portions 33*a* and 33*b* are embedded in the ceramic base 31. The heating element 32 is composed of a U-shaped conductive ceramic member that is disposed in the ceramic heater 30 to be located at its front end portion 36. The first lead portion 33*a* connects one end of the heating element 32 to a first electrode terminal portion 34, and the second lead portion 33*b* connects the other end of the heating element 32 to a second electrode terminal portion 35. In the following description, the first and second lead portions 33*a* and 33*b* may be collectively referred to simply as "lead portions 33." The first and second electrode terminal portions 34 and 35 are electrodes exposed at an outer circumferential surface 37 of the ceramic base 31. The first electrode terminal portion 34 is formed at a position closer to the rear end portion 38 than the second electrode terminal portion 35 and is in contact with the inner circumferential surface of the tubular member 40. The second electrode terminal portion 35 is in contact with the inner circumferential surface of the sleeve 50.

The tubular member 40 is a substantially tubular conductive member having an axial bore 41. The small-diameter portion 23 of the inner shaft 20 is press-fitted into the axial bore 41, and the rear end portion 38 of the ceramic heater 30 is also press-fitted into the axial bore 41, whereby the tubular member 40 holds the inner shaft 20 and the ceramic heater 30. As described above, the wall surface of the axial bore 41 of the tubular member 40 is in contact with the first electrode terminal portion 34 of the ceramic heater 30. The inner shaft 20 and the heating element 32 of the ceramic heater 30 are thereby electrically connected to each other through the tubular member 40. The tubular member 40 is spaced apart from the wall surface of the axial bore 13 of the metallic shell 10 and is thereby insulated from the metallic shell 10. The details of the shape of the tubular member 40 will be described later.

The sleeve 50 is formed of, for example, stainless steel and has an axial bore 51 and a small-diameter portion 52. The axial bore 51 is a hollow space extending in the axial direction of the sleeve 50, and the ceramic heater 30 is inserted into the axial bore 51. As described above, the wall surface of the axial bore 51 of the sleeve 50 is in contact with the second electrode terminal portion 35 of the ceramic heater 30. The heating element 32 of the ceramic heater 30 and the metallic shell 10 are thereby electrically connected to each other through the sleeve 50. The small-diameter portion 52 at the rear end of the sleeve 50 is a portion formed such that the outer diameter of the small-diameter portion 52 is smaller than the outer diameter of the rear portion of the sleeve 50. The small-diameter portion 52 is inserted into the front opening of the metallic shell 10.

The insulating member 60 is an annular member and is fitted into the rear opening of the metallic shell 10 with the inner shaft 20 inserted into the axial bore of the insulating member 60. The inner shaft 20 is thereby held by the metallic shell 10 with the electrical insulation between the metallic shell 10 and the inner shaft 20 being ensured. The O-ring 65 is attached to the outer circumference of the inner shaft 20 and disposed between the front end face of the insulating member 60 and the inner circumferential surface of the metallic shell 10. In this manner, airtightness inside the glow plug 1 is ensured. The annular member 70 is an annular conductive member and forms, together with the rear end portion 26 of the inner shaft 20, the terminal portion of the glow plug 1, as described above. The annular member 70 is disposed rearward of the insulating member 60 with the inner shaft 20 inserted into the axial bore of the annular member 70. The glow plug 1 may include, instead of the terminal portion composed of the rear end portion 26 of the inner shaft 20 and the annular member 70, a terminal portion composed of a portion of the inner shaft 20 that protrudes from the insulating member 60 and an external terminal that covers the protruding portion.

Figure 2:
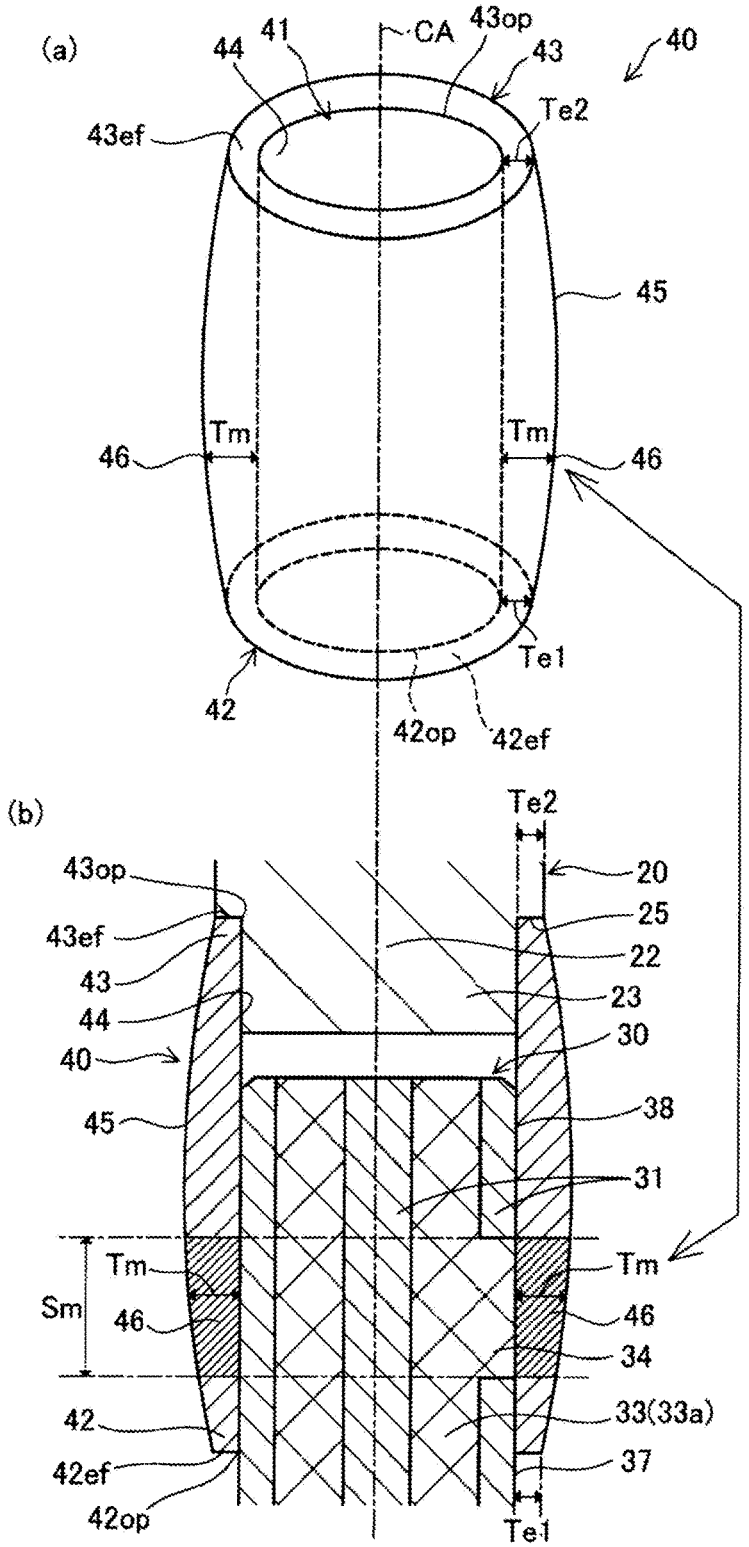
FIGS. 2(*a*) and 2(*b*) are a set of views schematically showing the structure of a tubular member.

FIG. 2 is a set of views schematically showing the structure of the tubular member 40. FIG. 2(*a*) schematically shows the structure of the tubular member 40 as viewed in an oblique direction. In FIG. 2(*a*), inner and back portions of the tubular member 40 are represented by broken lines. FIG. 2(*b*) is a schematic cross-sectional view similar to FIG. 1(*a*) and shows the tubular member 40 incorporated into the glow plug 1 and a region therearound. As shown in FIG. 2(*a*), the tubular member 40 includes the axial bore 41, a front end portion 42, a rear end portion 43, the inner circumferential surface 44, an outer circumferential surface 45, and an intermediate portion 46. The front end portion 42 and the rear end portion 43 are located at opposite ends in a direction along a virtual center axis CA of the tubular member 40 (this direction is hereinafter referred to as the "direction of the axis CA"). The front end portion 42 and the rear end portion 43 have a front end opening 42*op* and a rear end opening 43*op*, respectively, which are openings of the axial bore 41. The front end portion 42 and the rear end portion 43 also have a front end face 42*ef* and a rear end face 43*ef*, respectively, which are annular end faces forming the peripheral edges of these two openings 42*op* and 43*op*. As shown in FIG. 2(*b*), when the tubular member 40 is incorporated into the glow plug 1, the rear end portion 38 of the ceramic heater 30 is press-fitted into the front end opening 42*op* of the tubular member 40. As a result, the inner circumferential surface 44 of the tubular member 40 comes into contact with the outer circumferential surface 37 of the ceramic heater 30 and with the first electrode terminal portion 34. The front end portion 22 of the inner shaft 20 is press-fitted into the rear end opening 43*op* of the tubular member 40. As a result, the inner circumferential surface 44 of the tubular member 40 comes into contact with the small-diameter portion 23 of the inner shaft 20, and the rear end face 43*ef* of the tubular member 40 comes into contact with the step portion 25 of the inner shaft 20.

The tubular member 40 has a substantially barrel-like outer shape, i.e., a central portion (with respect to the direction of the axis CA) of the outer circumferential surface 45 of the tubular member 40 bulges outward (FIG. 2(*a*)). The tubular member 40 has the intermediate portion 46 located between the front end portion 42 and the rear end portion 43 and extending in the direction of the axis CA (FIG. 2(*b*)). The intermediate portion 46 is a portion of the tubular member 40 whose inner circumferential surface 44 is in contact with the first electrode terminal portion 34 of the ceramic heater 30 and which has a certain width Sm in the direction of the axis CA. The intermediate portion 46 may not be located at the center of the tubular member 40 in the direction of the axis CA (at a position at which the distances from the front end portion 42 and the rear end portion 43 are the same).

The tubular member 40 is formed such that a wall thickness Te1 at the front end portion 42 is smaller than a wall thickness Tm at the intermediate portion 46 (Tm>Te1). A "wall thickness" is a thickness of the tubular member 40 in a cross section perpendicular to the virtual center axis CA and is the difference between the distance from the virtual center axis CA to the outer circumferential surface 45 in the cross section and the distance from the virtual center axis CA to the inner circumferential surface 44 in the cross section. The wall thickness Te1 at the front end portion 42 is the width of the front end face 42*ef*. The wall thickness Tm at the intermediate portion 46 is the average wall thickness at the intermediate portion 46.

When the wall thickness Te1 at the front end portion 42 is smaller than the wall thickness Tm at the intermediate portion 46, the tightening force of the tubular member 40 acting on the ceramic heater 30 in a region around the front end portion 42 is smaller than that in a region around the intermediate portion 46. More specifically, the contact pressure between the tubular member 40 and the ceramic heater 30 in a region around the front end portion 42 is smaller than that in a region around the intermediate portion 46. When the contact pressure in a region around the front end portion 42 is small, the occurrence of breakage of the ceramic heater 30 in a region around the front end portion 42 is suppressed. The reason for this will be described later. In the tubular member 40 of the present embodiment, the outer circumferential surface 45 has a curved shape extending in the direction of the axis CA, and the wall thickness increases continuously from the front end portion 42 toward the intermediate portion 46. Therefore, the tightening force of the tubular member 40 acting on the ceramic heater 30 increases continuously from the front end portion 42 toward the intermediate portion 46. The occurrence of breakage of the ceramic heater 30 due to attachment of the tubular member 40 thereto is thereby suppressed. The reason for this will also be described later.

In addition, in the tubular member 40 of the present embodiment, a wall thickness Te2 at the rear end portion 43 is smaller than the wall thickness Tm at the intermediate portion 46 (Tm>Te2). With this configuration, breakage of the ceramic heater 30 is prevented regardless of whether the ceramic heater 30 is press-fitted into the front end portion 42 or the rear end portion 43. Therefore, it is not necessary to check the orientation of the tubular member 40 in the direction of the axis CA when the ceramic heater 30 is press-fitted into the tubular member 40. This saves time and effort required to orient the tubular member 40 during the production process, so that production cost can be reduced. In addition, the inner shaft 20 can be easily attached to the tubular member 40.

Figure 3:
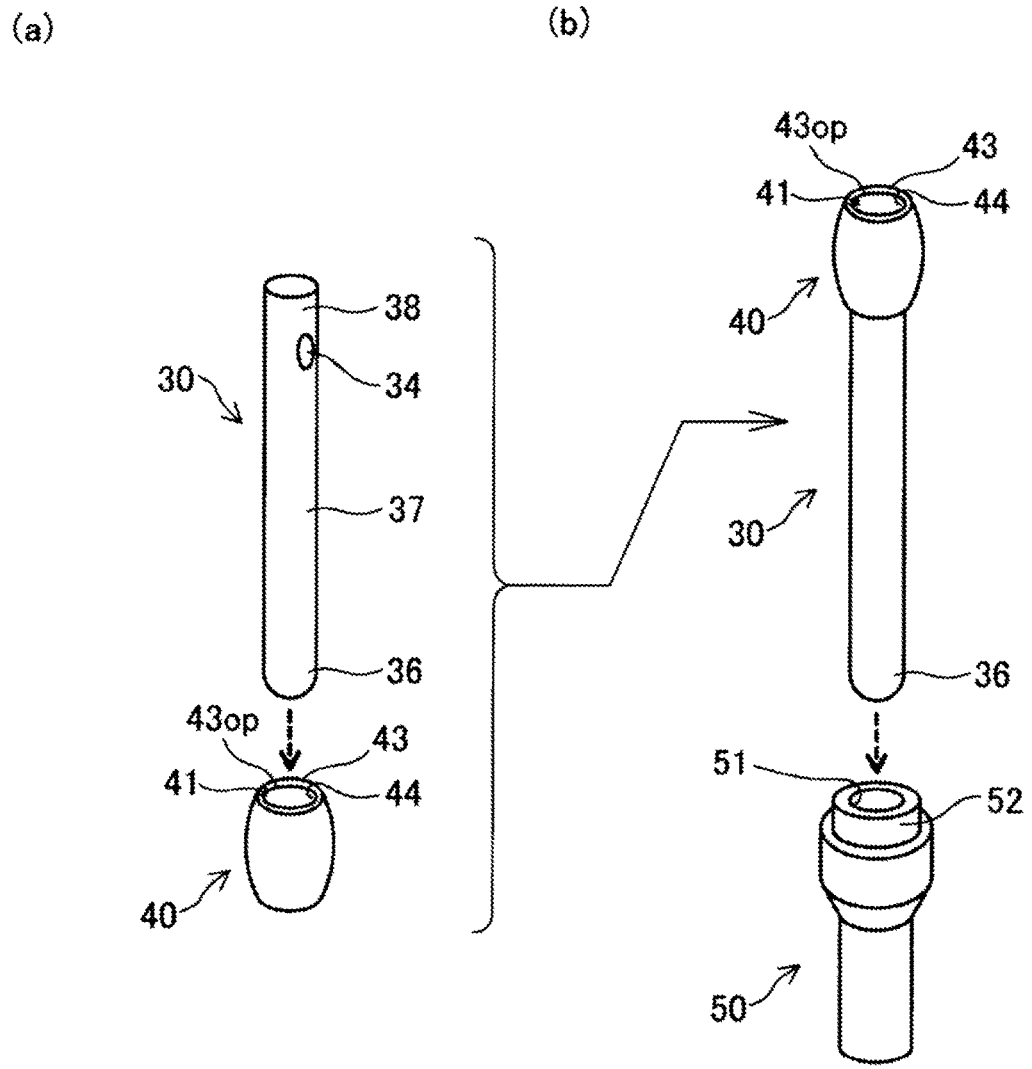
FIGS. 3(*a*) and 3(*b*) are a first set of views illustrating a procedure for assembling an inner shaft, a ceramic heater, a tubular member, and a sleeve.
Figure 4:
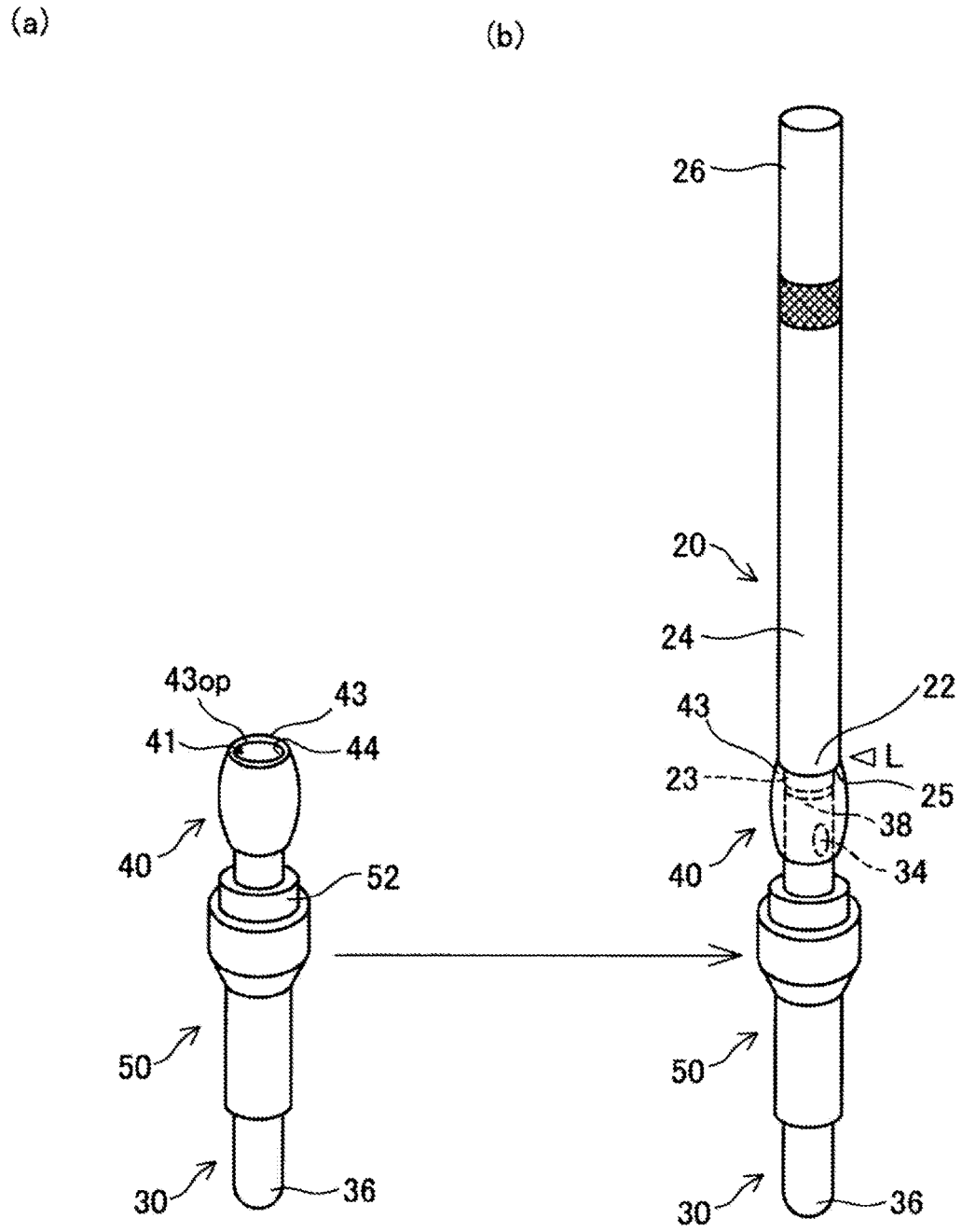
FIGS. 4(*a*) and 4(*b*) are a second set of views illustrating the procedure for assembling the inner shaft, the ceramic heater, the tubular member, and the sleeve.

FIGS. 3 and 4 show a procedure for assembling the inner shaft 20, the ceramic heater 30, the tubular member 40, and the sleeve 50. First, the ceramic heater 30 is press-fitted into the axial bore 41 of the tubular member 40 (FIG. 3(*a*)). More specifically, the ceramic heater 30 is inserted from the rear end opening 43*op* of the tubular member 40 and pressed into the tubular member 40 such that the first electrode terminal portion 34 of the ceramic heater 30 is located at the intermediate portion 46. Then the ceramic heater 30 with the tubular member 40 attached thereto is press-fitted into the axial bore 51 of the sleeve 50 (FIG. 3(*b*)). More specifically, the ceramic heater 30 is inserted from the rear end of the sleeve 50 and pressed into the sleeve 50 until the front end portion 36 of the ceramic heater 30 protrudes from the front end of the sleeve 50 (FIG. 4(*a*)). Then, the inner shaft 20 is press-fitted into the axial bore 41 of the tubular member 40 (FIG. 4(*b*)). More specifically, the inner shaft 20 is inserted from the rear end opening 43*op* of the tubular member 40. Then, laser welding is performed at the boundary L between the rear end portion 43 of the tubular member 40 and the small-diameter portion 23 of the inner shaft 20, and the inner shaft 20 and the tubular member 40 are thereby joined to each other. A component in which the inner shaft 20, the ceramic heater 30, the tubular member 40, and the sleeve 50 are integrated is formed through the above process. Then, the metallic shell 10, the insulating member 60, the O-ring 65, and the annular member 70 are attached to the above component, and the glow plug 1 is thereby completed.

Figure 5:
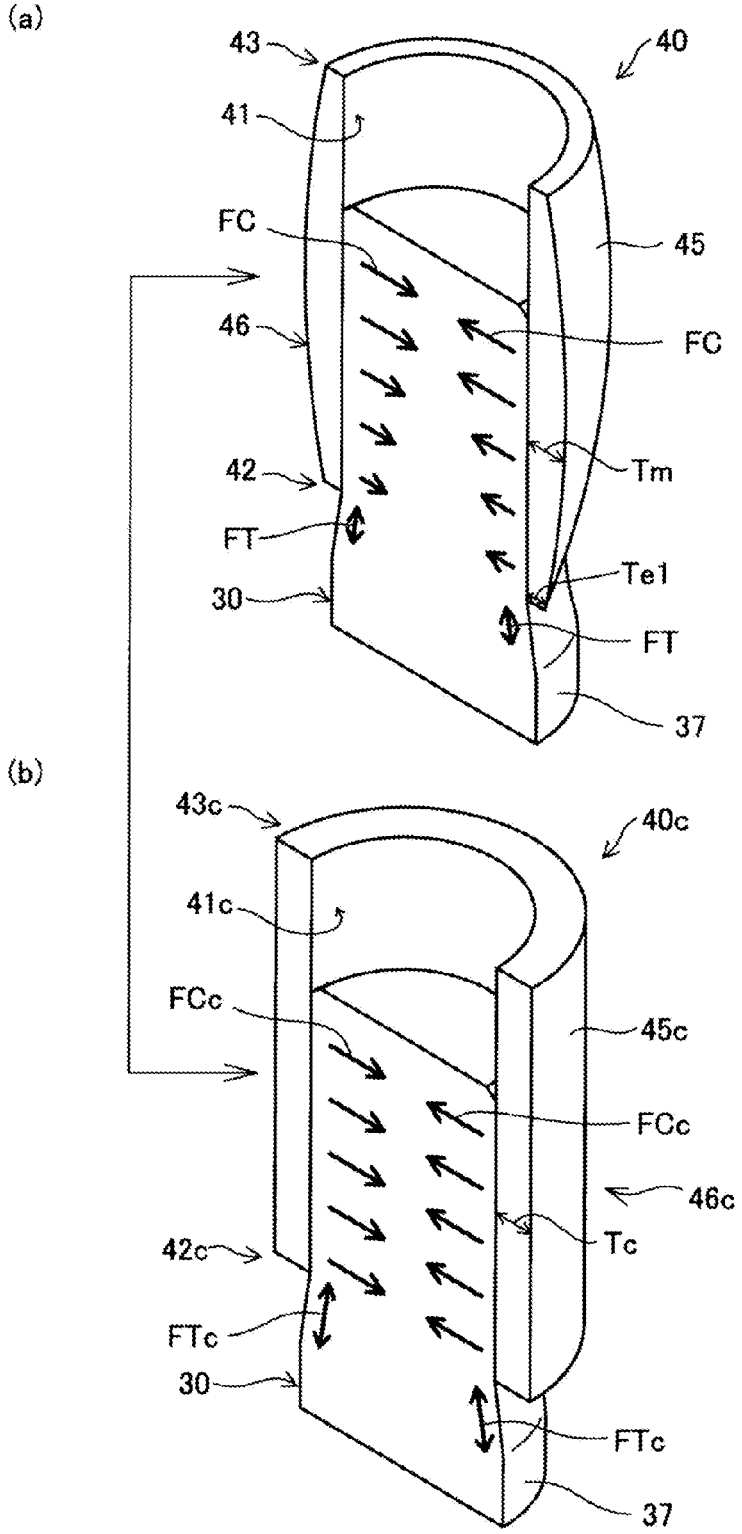
FIGS. 5(*a*) and 5(*b*) are a set of views illustrating, for comparison, a tubular member of the present embodiment and a conventional tubular member.

FIG. 5 is a set of views showing, for comparison, the tubular member 40 of the present embodiment and a conventional tubular member 40*c*. FIG. 5(*a*) exemplifies a cross-sectional configuration of the tubular member 40 of the present embodiment. FIG. 5(*b*) exemplifies a cross-sectional configuration of the conventional tubular member 40*c*. FIGS. 5(*a*) and 5(*b*) schematically show the tubular members 40 and 40*c* with ceramic heaters 30 press-fitted into the axial bores 41 and 41*c* of the tubular members 40 and 40*c*. In FIGS. 5(*a*) and 5(*b*), the lead portions 33 and the first electrode terminal portion 34 of each ceramic heater 30 are omitted. The conventional tubular member 40*c* has a substantially tubular shape, as does the tubular member 40 of the present embodiment. However, in contrast to the tubular member 40 of the present embodiment, the intermediate portion 46*c* of the outer circumferential surface 45*c* does not bulge outward. Therefore, the wall thickness Tc of the conventional tubular member 40*c* is constant from the front end portion 42*c* to the rear end portion 43*c*. In the following description, it is assumed that the wall thickness Tc of the conventional tubular member 40*c* and the wall thicknesses Tm and Te1 of the tubular member 40 of the present embodiment satisfy the relation Te1<Tc≅Tm.

The tubular member 40 of the present embodiment is configured such that the wall thickness gradually decreases from the intermediate portion 46 toward the front end portion 42. Therefore, the compressive stress FC produced in the ceramic heater 30 as a result of compression by the tubular member 40 gradually decreases from the intermediate portion 46 toward the front end portion 42. However, in the conventional tubular member 40*c*, since the wall thickness Tc is constant, the compressive stress FCc produced in the ceramic heater 30 as a result of compression by the tubular member 40*c* is constant at any axial position. Therefore, the compressive stress FC in a region around the front end portion 42 of the tubular member 40 of the present embodiment is smaller than the compressive stress FCc in a region around the front end portion 42*c* of the conventional tubular member 40*c*. Therefore, in the tubular member 40 of the present embodiment, the press-fitting load required when the ceramic heater 30 is press-fitted into the axial bore 41 of the tubular member 40 can be reduced. The reduction in the press-fitting load suppresses, for example, the occurrence of breakage of the ceramic heater 30 during press-fitting.

The compressive stress FC in a region around the intermediate portion 46 of the tubular member 40 of the present embodiment is substantially the same as the compressive stress FCc at a corresponding portion 46*c* of the conventional tubular member 40*c*. Therefore, in the tubular member 40 of the present embodiment, a sufficiently large contact pressure is produced at the contact surface between the tubular member 40 and the first electrode terminal portion 34 of the ceramic heater 30, and an increase in the contact resistance between the tubular member 40 and the first electrode terminal portion 34 of the ceramic heater 30 is suppressed.

In any of the tubular member 40 of the present embodiment and the conventional tubular member 40*c*, tensile stress FT (FTc) in a direction toward the axial bore 41, 41*c* is produced as residual stress in a region near the surface of a portion of the ceramic heater 30 that protrudes from the axial bore 41, 41*c*. The tensile stress FT (FTc) is a force produced when the ceramic heater 30 is compressed in a region near the front end portion 42, 42*c* of the tubular member 40 (40*c*) and the outer circumferential surface 37 of the ceramic heater 30 is thereby stretched. The tensile stress FT (FTc) increases in proportion to the magnitude of the compressive stress FC (FCc) in a region around the front end portions 42, 42*c*. As described above, in the tubular member 40 of the present embodiment, the compressive stress FC in a region around the front end portion 42 is smaller than the compressive stress FCc in the conventional tubular member 40*c*. Therefore, the tensile stress FT produced in the ceramic heater 30 press-fitted into the tubular member 40 of the present embodiment is smaller than the tensile FTc produced in the ceramic heater 30 press-fitted into the conventional tubular member 40*c*. In the tubular member 40 of the present embodiment, the occurrence of breakage of the ceramic heater 30 press-fitted into the axial bore 41 of the tubular member 40 is thereby suppressed.

As described above, in the glow plug 1 of the first embodiment, since the wall thickness Te1 at the front end portion 42 of the tubular member 40 is smaller than the wall thickness Tm at the intermediate portion 46, the occurrence of breakage of the ceramic heater 30 is suppressed. More specifically, since the tubular member 40 of the present embodiment has a reduced thickness in a region around the front end portion 42, the tightening force acting on the ceramic heater 30 is reduced in a region around the front end portion 42. Therefore, the press-fitting load required when the ceramic heater 30 is press-fitted into the axial bore 41 of the tubular member 40 is reduced, and the occurrence of breakage of the ceramic heater 30 during press-fitting is suppressed. In addition, since the compressive stress FC produced in a region around the front end portion 42 when the ceramic heater 30 is press-fitted into the tubular member 40 is reduced, the residual stress remaining in the ceramic heater 30 is reduced, and the occurrence of breakage of the ceramic heater 30 press-fitted into the tubular member 40 is thereby suppressed. Therefore, the vibration resistance and shock resistance of the glow plug 1 are improved. In addition, by reducing the wall thickness Te1 at the front end portion 42, production cost can be reduced.

In the glow plug 1 of the first embodiment, the tubular member 40 is in contact with the first electrode terminal portion 34 of the ceramic heater 30 in a region around the intermediate portion 46 having a wall thickness larger than the wall thickness of the front end portion 42. Therefore, an increase in the contact resistance between the tubular member 40 and the first electrode terminal portion 34 of the ceramic heater 30 is suppressed. More specifically, in the tubular member 40 of the present embodiment, since the wall thickness Tm at the intermediate portion 46 is larger than the wall thickness Te1 at the front end portion 42, the contact pressure applied to the ceramic heater 30 becomes sufficiently large in a region around the intermediate portion 46. Therefore, the increase in the contact resistance between the tubular member 40 and the first electrode terminal portion 34 of the ceramic heater 30 is suppressed, and a reduction in the heat generation efficiency of the glow plug 1 is suppressed.

In addition, in the glow plug 1 of the first embodiment, the wall thickness Te2 at the rear end portion 43 of the tubular member 40 is smaller than the wall thickness Tm at the intermediate portion 46. Therefore, even when the ceramic heater 30 is attached to the rear end portion 43, the stress generated in the ceramic heater 30 is suppressed, and the occurrence of breakage of the ceramic heater 30 is thereby suppressed. Since the ceramic heater 30 can be attached to any of the end portions 42 and 43 of the tubular member 40, it is not necessary to check the axial orientation of the tubular member 40 when the ceramic heater 30 is press-fitted into the tubular member 40. This saves time and effort required to orient the tubular member 40 during the production process, so that production cost can be reduced. In addition, the inner shaft 20 can be easily attached to the tubular member 40.

Moreover, in the glow plug 1 of the first embodiment, the tubular member 40 is formed such that the wall thickness increases continuously from the front end portion 42 toward the intermediate portion 46. Therefore, the contact pressure acting on the ceramic heater 30 increases continuously from the front end portion 42 toward the intermediate portion 46, and the compressive stress FC produced in the ceramic heater 30 increases continuously from the front end portion 42 toward the intermediate portion 46. Therefore, the residual stress remaining in the ceramic heater 30 due to variations in the magnitude of the compressive stress FC is thereby suppressed, so that the occurrence of breakage of the ceramic heater 30 is further suppressed.

B. Second Embodiment

Figure 6:
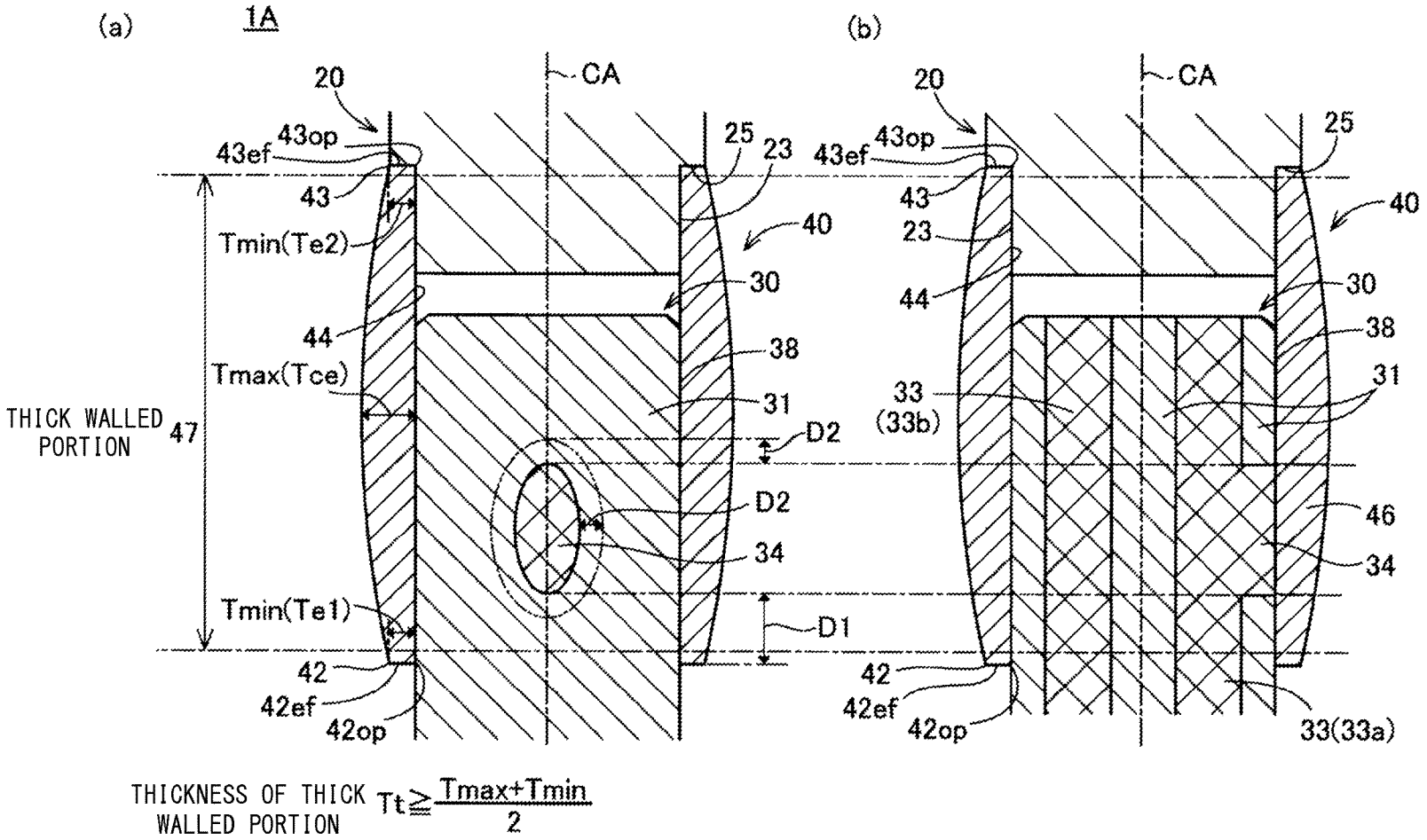
FIGS. 6(*a*) and 6(*b*) are a set of schematic views showing the structure of a glow plug of a second embodiment.

FIG. 6 is a set of views schematically showing the structure of a glow plug 1A of a second embodiment of the present invention. FIGS. 6(*a*) and (*b*) are schematic cross-sectional views similar to FIG. 2(*b*) and show portions around the tubular member 40. FIG. 6(*a*) is a schematic cross-sectional view of the glow plug 1A when the first electrode terminal portion 34 of the ceramic heater 30 is viewed from the front. FIG. 6(*b*) is a schematic cross-sectional view of the glow plug 1A when the first electrode terminal portion 34 is viewed from a side. In FIGS. 6(*a*) and 6(*b*), the same components as those described in the first embodiment are denoted by the same reference numerals. In FIGS. 6(*a*) and 6(*b*), the range of the intermediate portion 46 described in the first embodiment is omitted for convenience.

The glow plug 1A of the second embodiment has the same configuration as that of the glow plug 1 of the first embodiment except that the placement position of the first electrode terminal portion 34 with respect to the tubular member 40 is specified. The tubular member 40 of the glow plug 1A of the second embodiment has the same configuration as that described in the first embodiment. In the glow plug 1A of the second embodiment, the first electrode terminal portion 34 is disposed in a region spaced a prescribed first distance D1 apart from the front end opening 42*op* of the front end portion 42 of the tubular member 40. In addition, the first electrode terminal portion 34 is disposed at a position determined such that a region extending a prescribed second distance D2 from the periphery of the first electrode terminal portion 34 (this region is represented by a chain double-dashed line in FIG. 6(*a*)) is entirely covered with a thick walled portion 47 of the tubular member 40. The "thick walled portion 47" is a portion of the tubular member 40 which extends in the direction of the axis CA and in which the wall thickness is equal to or larger than the average of the minimum and maximum wall thicknesses of the tubular member 40. More specifically, the wall thickness Tt of the thick walled portion 47, the minimum wall thickness Tmin of the tubular member 40, and the maximum wall thickness Tmax of the tubular member 40 satisfy the relation Tt (Tmax+Tmin)/2. In the tubular member 40 of the second embodiment, the minimum wall thickness Tmin is equal to the wall thicknesses Te1 and Te2 at the front end portion 42 and the rear end portion 43, and the maximum wall thickness Tmax is equal to the wall thickness Tce at a central portion in the direction of the axis CA. In the tubular member 40 of the second embodiment, the thick walled portion 47 is located in a region spaced apart from the opposite opening end faces of the tubular member 40 and includes the intermediate portion 46 (FIG. 2) described in the first embodiment.

The present inventor has found that the above-described prescribed first and second distances D1 and D2 for specifying the placement position of the first electrode terminal portion 34 with respect to the tubular member 40 are each preferably 0.6 mm or more (D1, D2≥0.6 mm). As described later, when the two distances D1 and D2 are each 0.6 mm or more, deterioration of the first electrode terminal portion 34 is suppressed, and a reduction in heat generation efficiency of the ceramic heater 30 is suppressed. The tubular member 40 may be thermally expanded when placed in, for example, a high-temperature environment of 100° C. or higher. When at least the first distance D1 is 0.6 mm or more, oxygen entering the gap between the tubular member 40 and the ceramic heater 30 through the front end opening 42*op* of the tubular member 40 is restrained from reaching the first electrode terminal portion 34 even when the tubular member 40 is thermally expanded. When the second distance D2, as well as the first distance D1, is 0.6 mm or more, a distance that can restrain oxygen from reaching the first electrode terminal portion 34 is ensured over the entire periphery of the first electrode terminal portion 34, and the contact pressure acting on this peripheral region from the tubular member 40 is ensured by the thick walled portion 47. Therefore, oxygen is more reliably restrained from reaching the first electrode terminal portion 34. When oxygen is restrained from reaching the first electrode terminal portion 34, oxidation of the first electrode terminal portion 34 is suppressed, and an increase in contact resistance between the tubular member 40 and the first electrode terminal portion 34 is suppressed. Therefore, a reduction in the heat generation efficiency of the ceramic heater 30 is suppressed.

Figures 7, 8:
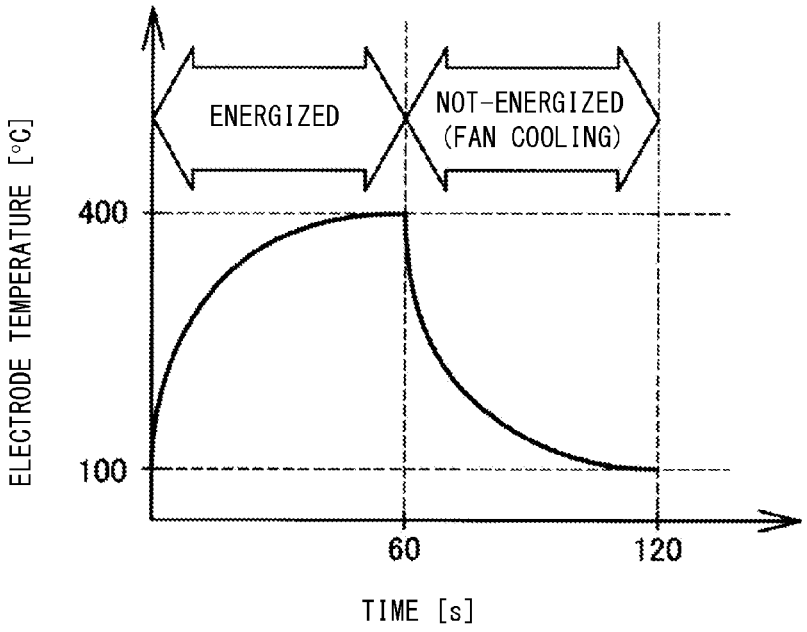
FIG. 7 is an explanatory diagram showing the results of experiments performed to examine the effect of suppressing deterioration at different placement positions of a first electrode terminal portion.
FIG. 8 is an explanatory diagram illustrating the experimental conditions of the experiments performed to examine the effect of suppressing deterioration at different placement positions of the first electrode terminal portion.

FIGS. 7 and 8 are diagrams for explaining experiments performed to examine the effect of suppressing deterioration at different placement positions of the first electrode terminal portion 34 with respect to the tubular member 40. FIG. 7 is an explanatory diagram showing a table of the experimental results, and FIG. 8 is an explanatory diagram illustrating the experimental conditions. FIG. 8 is a graph showing the temporal change of the temperature of the first electrode terminal portion 34 (hereinafter may be referred to simply as "electrode temperature"). Samples S1 to S7 used in the experiments were test samples of the second glow plug 1A and had the same configuration except that the distance D1 between the first electrode terminal portion 34 and the opening 42*op* of the front end portion 42 of the tubular member 40 was changed. In these experiments, energization processing including energization for 60 seconds and non-energization for 60 seconds was repeated prescribed times for each of samples S1 to S7 to periodically change the electrode temperature of the each of samples S1 to S7 between 100° C. and 400° C. (FIG. 8). During the non-energization period in the energization processing, each of samples S1 to S7 was subjected to cooling treatment using a cooling fun. In these experiments, the amount of change in the contact resistance between the first electrode terminal portion 34 and the tubular member 40 before and after the energization processing was measured. In the table in FIG. 7, a sample with a change in the contact resistance of 10 mΩ or less is evaluated as "acceptable," and a sample with a change in the contact resistance of greater than 10 mΩ is evaluated as "unacceptable." As shown in the table, for each of samples S1 to S6 with a distance D1 of 0.60 mm or more, the change in the contact resistance was 10 mΩ or less, and good evaluation results were obtained. However, the change in the contact resistance was greater than 10 mΩ for sample S7 with a distance D1 of less than 0.60 mm.

As described above, in the glow plug 1A of the second embodiment, the first electrode terminal portion 34 of the ceramic heater 30 is disposed at a suitable position with respect to the tubular member 40, so that oxidation of the first electrode terminal portion 34 is suppressed. Therefore, a reduction in the heat generation efficiency of the ceramic heater 30 is suppressed.

C. Third Embodiment

Figure 9:
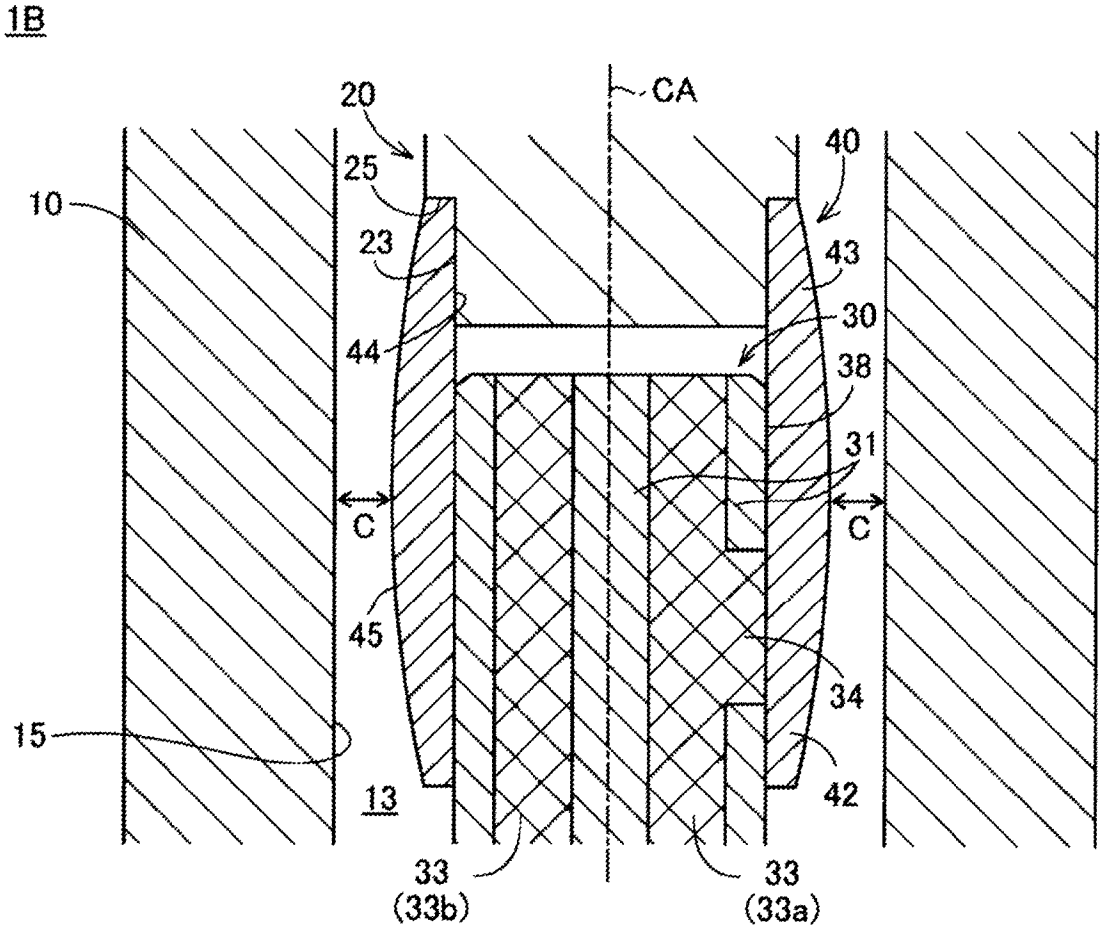
FIG. 9 is a schematic view showing the structure of a glow plug of a third embodiment.

FIG. 9 is a schematic view showing the structure of a glow plug 1B of a third embodiment. FIG. 9 is substantially the same as FIG. 6(*b*) except that part of the metallic shell 10 is additionally shown and the illustration of the thick walled portion 47 is omitted. In FIG. 9, the same components as those described in the first and second embodiments are denoted by the same reference numerals. The glow plug 1B of the third embodiment has substantially the same configuration as the glow plug 1A of the second embodiment except that the separation distance between the metallic shell 10 and the tubular member 40 is specified. In the glow plug 1B of the third embodiment, the separation distance C between the metallic shell 10 and the tubular member 40 is specified to be at least 0.2 mm or more. The separation distance C is the minimum distance between the wall surface 15 of the axial bore 13 of the metallic shell 10 and the outer circumferential surface 45 of the tubular member 40. More specifically, the separation distance C in the glow plug 1B of the third embodiment is the minimum distance between the wall surface 15 of the axial bore 13 of the metallic shell 10 and the central portion, with respect to the direction of the axis CA, of the outer circumferential surface 45 of the tubular member 40, the central portion being the most bulging portion of the outer circumferential surface 45 of the tubular member 40. In the glow plug 1B of the third embodiment, the separation distance C is specified to be 0.2 mm or more to thereby suppress the occurrence of a short circuit between the metallic shell 10 and the tubular member 40.

Figures 10, 11:
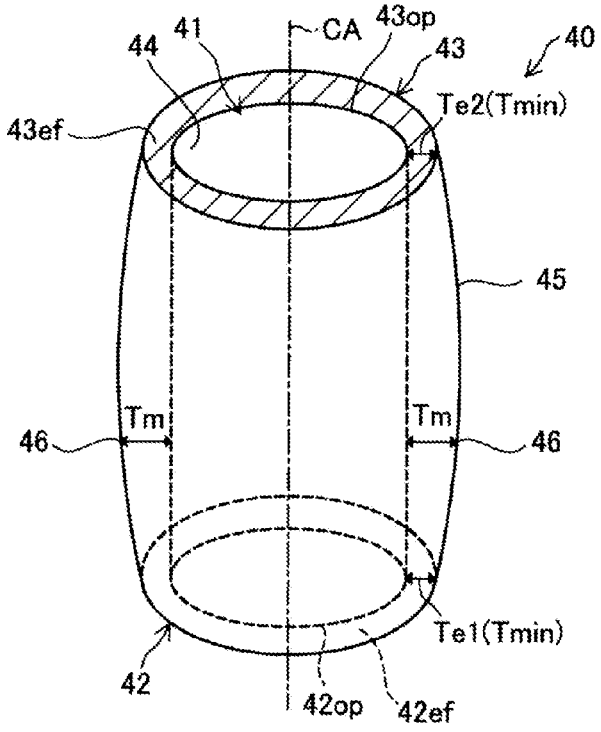
FIG. 10 is an explanatory diagram showing the results of experiments performed to examine the effect of suppressing the occurrence of a short circuit at different separation distances between a metallic shell and a tubular member.
FIG. 11 is a schematic view showing the structure of a tubular member of a fourth embodiment.

FIG. 10 is an explanatory diagram showing the results of experiments performed to examine the effect of suppressing the occurrence of a short circuit at different separation distances C between the metallic shell 10 and the tubular member 40. Samples S11 to S16 used in the experiments were test samples of the glow plug 1B of the third embodiment. Samples S11 to S16 had the same configuration except that the diameter of the axial bore 13 of the metallic shell 10 was changed to change the separation distance C between the metallic shell 10 and the tubular member 40. In these experiments, a time used to consume a prescribed amount of electric power was measured for each of samples S11 to S16, and the occurrence of a short circuit between the metallic shell 10 and the tubular member 40 was judged according to the time measured. In the table in FIG. 10, a sample in which the time measured was equal to or longer than a preset specified time is evaluated as "acceptable," i.e., no short circuit occurred in the sample. A sample in which the time measured was shorter than the specified time is evaluated as "unacceptable," i.e., a short circuit occurred in the sample. As shown in the table, no short circuit was detected in samples S11 to S15 with a separation distance C of 0.2 mm or more, and a short circuit was detected in sample S16 with a separation distance C of 0.1 mm.

As described above, in the glow plug 1B of the third embodiment, the separation distance C between the metallic shell 10 and the tubular member 40 is properly determined, so that the occurrence of a short circuit between the metallic shell 10 and the tubular member 40 is suppressed. Therefore, a reduction in the heat generation efficiency of the ceramic heater 30 is suppressed.

D. Fourth Embodiment

FIG. 11 is a view showing the structure of the tubular member 40 included in a glow plug of a fourth embodiment of the present invention. FIG. 11 is substantially the same as FIG. 2(*a*) except that the rear end face 43*ef* of the rear end portion 43 of the tubular member 40 is hatched to indicate that the rear end face 43*ef* is a cross section of a minimum wall-thickness portion (described later). In FIG. 11, the same components as those described in the first to third embodiments are denoted by the same reference numerals. The tubular member 40 of the fourth embodiment has substantially the same configuration as that of the tubular member 40 described in the first to third embodiments except that the cross-sectional area of a cross-section perpendicular to the direction of the axis CA is specified. In the fourth embodiment, it is preferable that the material forming the tubular member 40 has a Vickers hardness at 20° C. of 200 HV or more.

In the tubular member 40 of the fourth embodiment, the area Smin of a cross section perpendicular to the direction of the axis CA and taken at a portion at which the wall thickness Tm is minimum (this portion may be hereinafter referred to as a "minimum wall-thickness portion") is specified as follows. The area Smin of the cross section of the minimum wall-thickness portion is specified such that a load in the direction of the axis CA applied to the tubular member 40 when the ceramic heater 30 is press-fitted thereinto (this load is hereinafter referred to as a "press-fitting load") does not produce a stress larger than 0.2% proof stress in the minimum wall-thickness portion. More specifically, the area Smin of the cross section of the minimum wall-thickness portion is specified as a value equal to or larger than a value obtained by dividing an estimated maximum value Lmax of the press-fitting load by an upper limit stress Pmax that is the upper limit of stress at which permanent strain in the material forming the tubular member 40 is suppressed to 0.2% (formula (1) below). The upper limit stress Pmax corresponds to the 0.2% proof stress of the material forming the tubular member 40.

$$Smin \geq Lmax/Pmax \quad (1)$$

In the tubular member 40 of the present embodiment, the wall thicknesses Te1 and Te2 at the front end face 42*ef* and the rear end face 43*ef* are each the minimum thickness Tmin, and therefore the front end face 42*ef* and the rear end face 43*ef* each correspond to the cross section of the minimum wall-thickness portion. Since the area Smin of the cross section of the minimum wall-thickness portion is specified on the basis of the 0.2% proof stress of the material forming the tubular member 40 as described above, the strength of the tubular member 40 against press-fitting of the ceramic heater 30 thereinto is ensured even at the minimum wall-thickness portion having the lowest strength. Therefore, deformation of the tubular member 40 when the ceramic heater 30 is press-fitted is suppressed.

Figure 12:
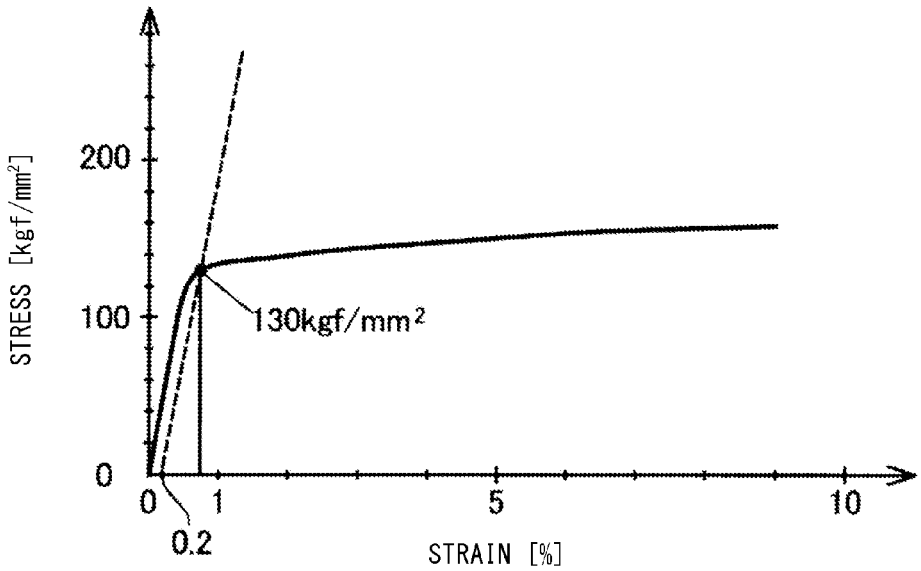
FIG. 12 is an explanatory diagram for explaining an example of a specific method of specifying the area of a cross section of a minimum wall-thickness portion.

FIG. 12 is an explanatory diagram for explaining an example of a specific method of specifying the area Smin of the cross section of the minimum wall-thickness portion. FIG. 12 shows a stress-strain curve (hereinafter may be referred to as an "S-S curve") of a metal material (subjected to heat treatment, hardness: 200 HV or more) obtained by an experiment by the present inventor. The 0.2% proof stress (upper limit stress) of the material is obtained from the S-S curve as 130 kgf/mm$^2$. Generally, the maximum value Lmax of the press-fitting load in a process of producing a glow plug is estimated to be about 200 kgf. Therefore, the area Smin of the cross section of the minimum wall-thickness portion is specified using the above-mentioned formula (1) as follows.

$$Smin \geq 200\ [kgf]/130\ [kgf/mm^2] = 1.5\ [mm^2]$$

More specifically, when the tubular member 40 is formed of a material with a 0.2% proof stress of 130 kgf/mm$^2$ or less, the area Smin of the cross section of the minimum wall-thickness portion is specified to be 1.5 mm$^2$ or more, and deformation of the tubular member 40 when the ceramic heater 30 is press-fitted thereinto is thereby suppressed. In this case, it is more preferable that the area Smin of the cross section of the minimum wall-thickness portion is 2 mm$^2$ or more. When the area Smin of the cross section of the minimum wall-thickness portion is 1.5 mm$^2$ and the outer diameter $\phi_{CH}$ of the ceramic heater 30 is 3.1 mm, it is preferable that the minimum thickness Tmin of the tubular member 40 is specified as follows.

$$Tmin = (\phi_{min} - \phi_{CH})/2 = 0.15$$

$\phi_{min}$: the outer diameter of the minimum wall-thickness portion $$\phi_{min} = [\{(Smin + S_{CH})\}/\pi]\hat{}(1/2)] \times 2$$

$S_{CH}$: the cross-sectional area of the ceramic heater 30

When the outer diameter $\phi_{CH}$ of the ceramic heater 40 is 3.1 mm as described above, it is preferable that the thickness Tmin of the minimum wall-thickness portion of the tubular member 40 is 0.15 mm or more.

As described above, in the glow plug of the fourth embodiment, since the lower limit of the cross-sectional area of the minimum wall-thickness portion of the tubular member 40 is specified on the basis of the 0.2% proof stress of the constituent material, deformation and damage caused by press-fitting of the ceramic heater 40 are suppressed.

E. Modifications

The present invention is not limited to the above-described embodiments and may be embodied in various forms without departing from the scope of the invention. For example, the following modifications are possible.

E-1. Modification 1

Figure 13:
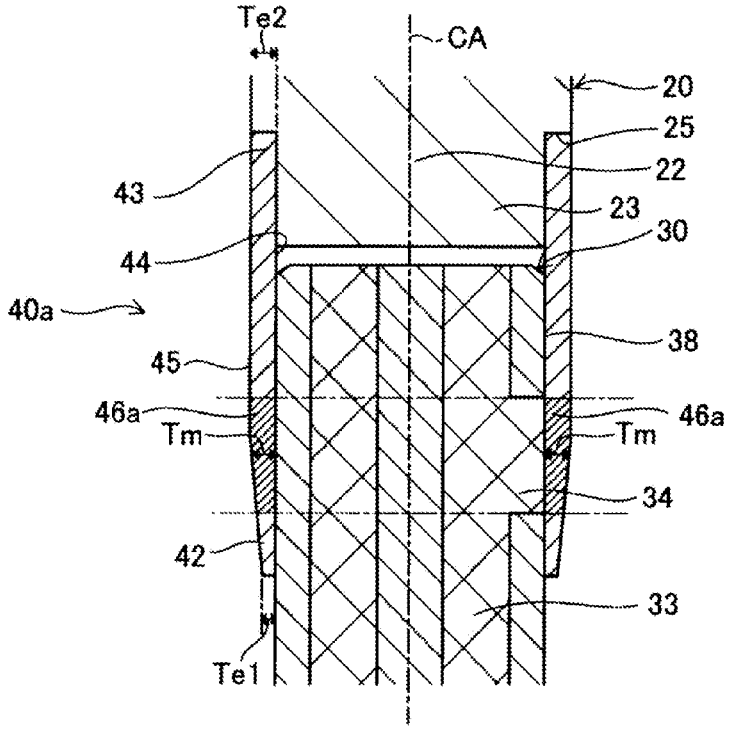
FIG. 13 is a view schematically showing the structure of a tubular member according to a modification.
Figure 14:
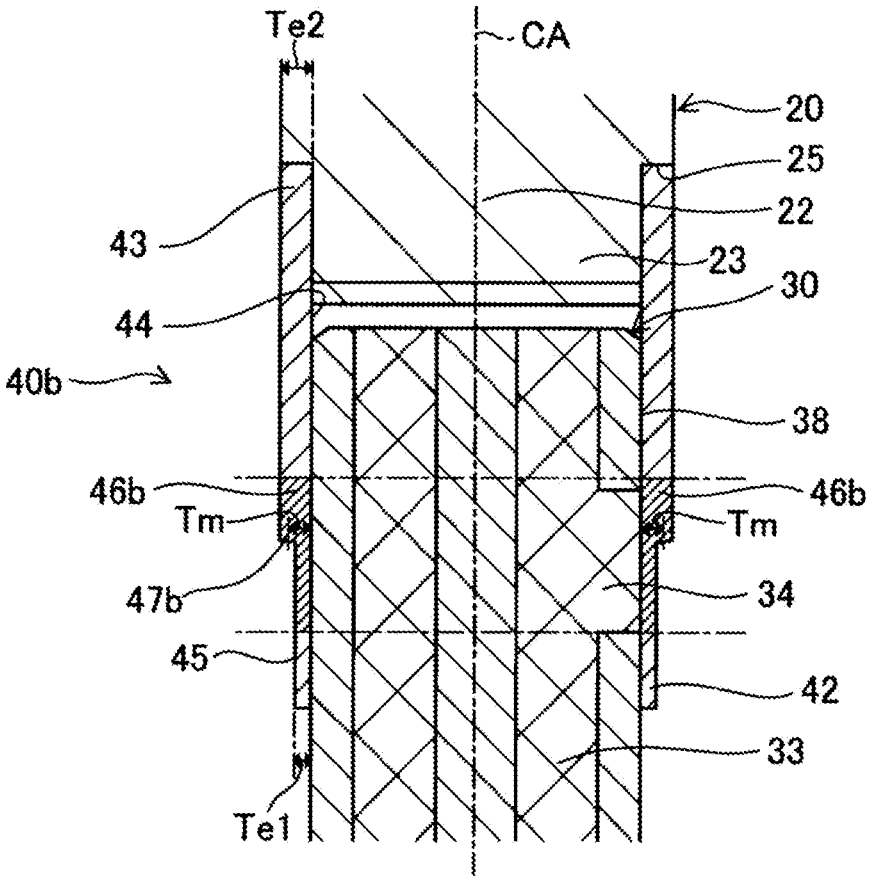
FIG. 14 is a view schematically showing the structure of a tubular member according to another modification.

FIGS. 13 and 14 are views schematically showing the structures of tubular members according to modifications. In FIGS. 13 and 14, the same components as those described in the above embodiments are denoted by the same reference numerals. The tubular member 40 used in each of the above embodiments has a substantially barrel-like outer shape. However, the tubular member 40 may have a shape other than the barrel-like shape. For example, the wall thickness Te2 at the rear end portion 43 may be equal to or greater than the wall thickness Tm at the intermediate portion 46*a*, as in a tubular member 40*a* shown in FIG. 13. A step portion 47*b* may be formed on the outer circumferential surface 45 of the intermediate portion 46*b* so as to render the wall thickness Te1 at the front end portion 42 smaller than the wall thickness Tm at the intermediate portion 46*b*, as in a tubular member 40*b* shown in FIG. 14. The tubular member 40 is not required to continuously increase its wall thickness from the front end portion 42 toward the intermediate portion 46. The tubular member 40 may have a circumferential groove extending in the circumferential direction of the outer circumferential surface 37 of the ceramic heater 30, to thereby have a reduced wall thickness at a certain axial position.

E-2. Modification 2

In the first embodiment described above, the wall thickness Te1 at the front end portion 42 of the tubular member 40, the wall thickness Tm at the intermediate portion 46, and the wall thickness Tc of the conventional tubular member 40*c* satisfy the relation Te1<Tc≅Tm. However, the wall thicknesses Te1 and Tm of the tubular member 40 in each of the above embodiments and the wall thickness Tc of the conventional tubular member 40*c* may satisfy the relation Te1<Tm<Tc or may satisfy the relation Te1<Tc<Tm.

E-3. Modification 3

In the first embodiment described above, the wall thickness Tm at the intermediate portion 46 of the tubular member 40 is the average wall thickness of the intermediate portion 46. However, the wall thickness Tm at the intermediate portion 46 may be the maximum wall thickness of the intermediate portion 46 or the minimum wall thickness thereof.

E-4. Modification 4

In the first embodiment described above, the ceramic heater 30 is press-fitted into the tubular member 40 from the rear end opening 43*op* during assembly of the glow plug 1. However, in the tubular member 40 in any of the embodiments, the ceramic heater 30 may be press-fitted from the front end opening 42*op*.

E-5. Modification 5

In the glow plugs in the above embodiments, the diameter of the axial bore 41 of the tubular member 40 is substantially constant in the direction of the axis CA. However, the axial bore 41 of the tubular member 40 may vary in the direction of the axis CA.

E-6. Modification 6

In each of the above embodiments, the tubular member 40 may be disposed at a position at which the first electrode terminal portion 34 is in contact with a portion of the tubular member 40 at which the wall thickness is maximum. In this configuration, the contact pressure acting on the first electrode terminal portion 34 from the tubular member 40 is more reliably secured, so that the heat generation efficiency of the ceramic heater 30 is ensured.

DESCRIPTION OF REFERENCE NUMERALS

1, 1A, 1B: glow plug
10: metallic shell
11: mounting screw portion
12: tool engagement portion
13: axial bore
15: wall surface
20: inner shaft
22: front end portion
23: small-diameter portion
24: main shaft portion
25: step portion
26: rear end portion
30: ceramic heater
31: ceramic base
32: heating element
33: lead portion
34: first electrode terminal portion
35: second electrode terminal portion
36: front end portion
37: outer circumferential surface
38: rear end portion
40, 40*a*, 40*b*: tubular member
41: axial bore
42: front end portion
43: rear end portion
44: inner circumferential surface
45: outer circumferential surface
46: intermediate portion
47: thick walled portion
50: sleeve
51: axial bore
52: small-diameter portion
60: insulating member
65: O-ring
70: annular member

The invention claimed is:

1. A glow plug comprising:

a rod-shaped heater extending along an axis and including a resistance heating element held inside the heater;

a tubular metallic shell which accommodates the heater with a front end portion of the heater protruding from the metallic shell;

a rod-shaped inner shaft which is accommodated in the metallic shell and to which electric current is applied externally; and a conductive tubular member disposed inside the metallic shell, the tubular member having a first end with an opening into which a rear end portion of the heater is press-fitted and a second end with an opening into which a front end portion of the inner shaft is inserted, whereby the resistance heating element of the heater and the inner shaft are electrically connected to each other;

the glow plug being characterized in that the heater includes an electrode terminal portion formed on an outer circumferential surface thereof and electrically connected to the resistance heating element, the tubular member includes an intermediate portion located between the first end and the second end and in contact with the electrode terminal portion, and a wall thickness of the tubular member at the first end is smaller than a wall thickness of the tubular member at the intermediate portion, wherein the tubular member increases in wall thickness continuously from the first end toward the intermediate portion.

2. A glow plug according to claim 1, wherein a wall thickness of the tubular member at the second end is smaller than the wall thickness of the tubular member at the intermediate portion.

3. A glow plug according to claim 1, wherein a distance between the electrode terminal portion of the heater and an end face of the tubular member located at the first end and having the opening is 0.6 mm or more.

4. A glow plug according to claim 3, wherein the tubular member has a thick walled portion including the intermediate portion and having a wall thickness equal to or greater than the average of the minimum and maximum values of the wall thickness of the tubular member, and the thick walled portion is disposed so as to entirely cover at least a region extending 0.6 mm from an outer circumference of the electrode terminal portion of the heater.

5. A glow plug according to claim 1, wherein a distance between an outer circumferential surface of the tubular member and an inner circumferential surface of the metallic shell is at least 0.2 mm.

6. A glow plug according to claim 1, wherein, in the tubular member, an area of a cross section thereof that is perpendicular to a virtual center axis of the tubular member and is taken at a minimum wall-thickness portion having a minimum wall thickness is determined on the basis of a 0.2% proof stress of a material forming the tubular member.

7. A glow plug according to claim 6, wherein the tubular member is formed of a material having a 0.2% proof stress of 130 $kgf/mm^2$ or less, and the area of the cross section at the minimum wall-thickness portion is 1.5 $mm^2$ or more.

8. A glow plug according to claim 1, wherein the tubular member is in contact with the electrode terminal portion at a position at which the tubular member has the maximum wall thickness.

* * * * *